US007748299B2

(12) United States Patent
Wu

(10) Patent No.: US 7,748,299 B2
(45) Date of Patent: Jul. 6, 2010

(54) WRENCH WITH MOVABLE JAW SUITABLE FOR BOTH METRIC AND ENGLISH SYSTEMS

(75) Inventor: Arthur Wu, Taichung County (TW)

(73) Assignee: Proxene Tools Co., Ltd., Taichung County (TW)

( * ) Notice: Subject to any disclaimer, the term of this patent is extended or adjusted under 35 U.S.C. 154(b) by 100 days.

(21) Appl. No.: 11/987,591

(22) Filed: Dec. 3, 2007

(65) Prior Publication Data

US 2009/0120246 A1 May 14, 2009

(30) Foreign Application Priority Data

Nov. 12, 2007 (TW) ..... 96142656 A

(51) Int. Cl.
*B25B 13/22* (2006.01)

(52) U.S. Cl. ..... 81/145

(58) Field of Classification Search ..... 81/128, 81/129, 129.5, 134–154
See application file for complete search history.

(56) References Cited

U.S. PATENT DOCUMENTS

| | | | | |
|---|---|---|---|---|
| 1,523,093 | A * | 1/1925 | Wilcox | 81/145 |
| 3,376,767 | A * | 4/1968 | O'Quinn | 81/145 |
| 5,020,777 | A * | 6/1991 | Yocum | 254/95 |
| 5,739,448 | A * | 4/1998 | Toscano | 84/413 |
| 2005/0103167 | A1 * | 5/2005 | Stewart et al. | 81/64 |

* cited by examiner

*Primary Examiner*—D. S Meislin
(74) *Attorney, Agent, or Firm*—Muncy, Geissler, Olds & Lowe, PLLC

(57) ABSTRACT

A wrench includes a fixed jaw and a sliding jaw which has a cylindrical guide portion and two toothed surfaces are defined in axial direction of the portion. The two toothed surfaces are made by Metric and English systems respectively. Two pawls are engaged with a through hole in the head each include an engaging surface in a first end thereof and the engaging surface is composed of teeth which are removably engaged with on of the two toothed surfaces. The two respective engaging surfaces of the two pawls are made by Metric and English systems respectively. An operation unit controls the two pawls to be engaged with or disengaged from the two toothed surfaces of the sliding jaw.

9 Claims, 8 Drawing Sheets

WRENCH WITH MOVABLE JAW SUITABLE FOR BOTH METRIC AND ENGLISH SYSTEMS

BACKGROUND OF THE INVENTION (1) Field of the Invention

The present invention relates to a wrench with a fixed jaw and a sliding jaw which is alternatively controlled by two pawls which are made in Metric and English systems.

(2) Description of the Prior Art

A conventional wrench with a sliding jaw and a fixed jaw is used to clamp an object such as a nut or a bolt head of different sizes. The sliding jaw is movable relative to the fix jaw so that the distance between the two jaws can be controlled by the users to adapt the objects of different sizes. The sliding jaw includes a cylindrical guide portion which is movably received in a groove in the head of the wrench and the guide portion is a rack. An adjustment screw is rotatably connected to the handle and engaged with the rack so that when the user rotates the adjustment screw, the sliding jaw is moved toward the fixed jaw or away from the fixed jaw. The rack and the adjustment screw are made in Metric system or English system so that when using the wrench with Metric system cannot precisely hold the object of English system. A small gap is defined between the two jaws and the sides of the object, and this might damage the object.

The present invention intends to provide a wrench wherein the guide portion includes two toothed surfaces made by Metric and English systems respectively, two pawls are movably connected to the wrench to respectively engaged with the two toothed surfaces so as to properly clamp the object.

SUMMARY OF THE INVENTION

The present invention relates to a wrench which comprises a handle with a head connected to an end of the handle. The head includes a fixed jaw and a groove is defined in an end of the head and opens through a top surface of the head. A through hole is defined through the head and an axis of the through hole is perpendicular to an axis of the groove. A sliding jaw includes a cylindrical guide portion which includes two toothed surfaces defined in axial direction of the portion. The guide portion is movably inserted into the groove. A control unit includes two pawls which are engaged with the through hole and located on two sides of the head. Each pawl includes an engaging surface in a first end thereof and the engaging surface is composed of teeth which are removably engaged with one of the two toothed surfaces. A second end of each pawl is biased by a resilient member which pushes the pawl toward the guide portion. An operation unit includes two operation members and at least one pin. The two operation members are located on the two sides of the head and the pin connects the operation members and the pawls on the two sides of the head. The two toothed surfaces and the two engaging surfaces are made by Metric and English systems respectively.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
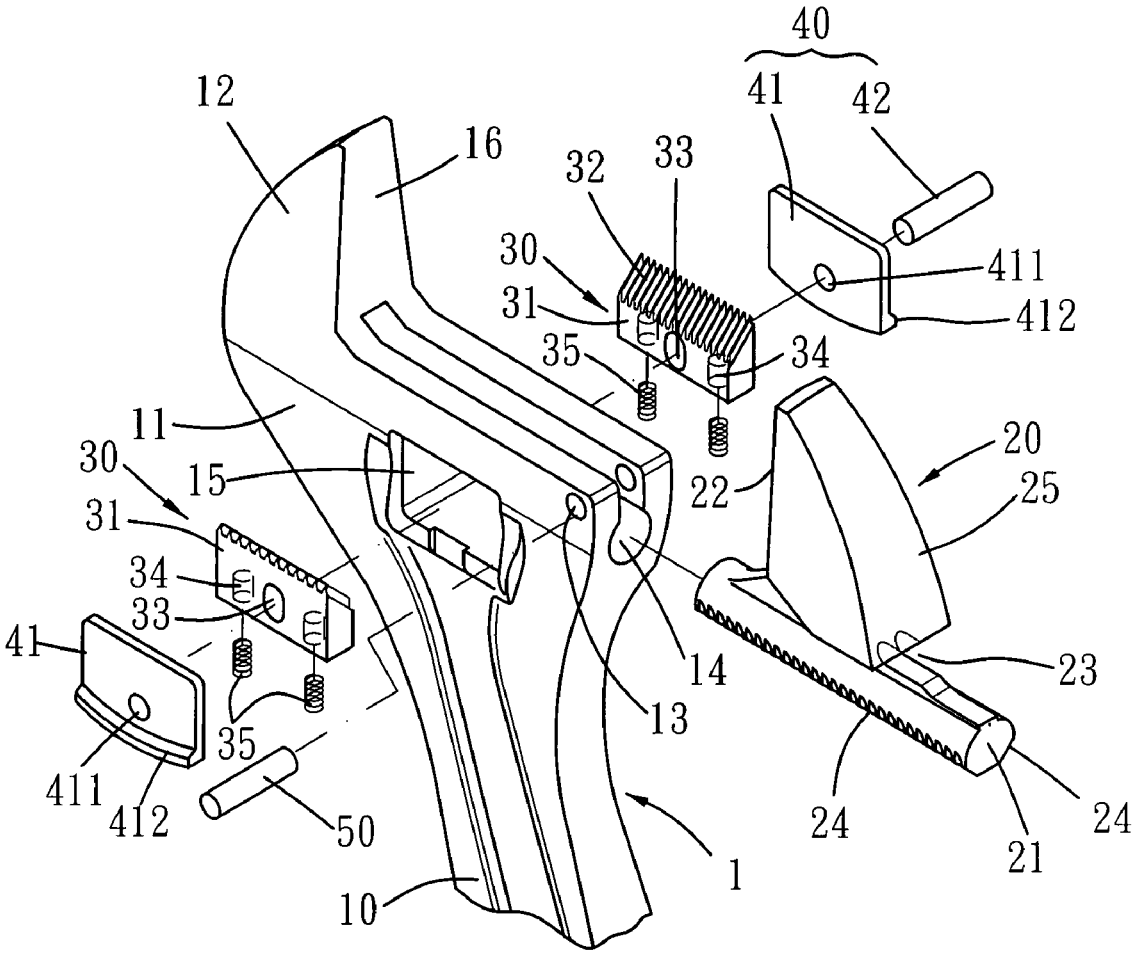
FIG. 1 is an exploded view to show the wrench of the present invention.
Figure 2:
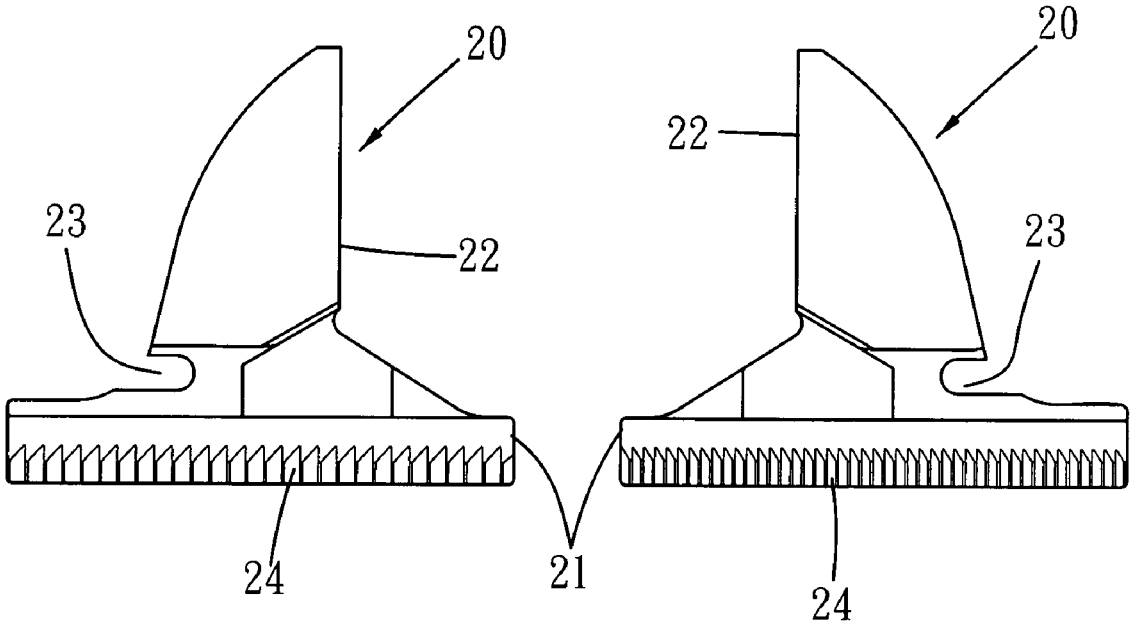
FIG. 2 shows that the two toothed surfaces of the guide portion have different pitches.

Referring to FIGS. 1 to 4, the wrench 1 of the present invention comprises a handle 10 and a head 11 is connected to an end of the handle 10. The head 11 includes a fixed jaw 12 extending from one end of the top surface thereof and a groove 14 is defined in the other end of the head 11 and opens through the top surface of the head 11. The fixed jaw 12 includes a first clamp surface 16. A through hole 15 is defined through the head 11 and an axis of the through hole 15 is perpendicular to an axis of the groove 14.

A sliding jaw 20 includes a jaw portion 25 and a cylindrical guide portion 21 is connected to an underside or the jaw portion 25. The jaw portion 25 includes a second clamp surface 22 which faces the first clamp surface 16 of the fixed jaw 12. The guide portion includes two toothed surfaces 24 defined in axial direction of the guide portion 21 and along two sides of an underside of the guide portion 21. The guide portion 21 is movably inserted into the groove 14. The sliding jaw 20 includes a concavity 23 defined in a conjunction portion of the jaw portion 25 and the guide portion 21. Two passages 13 are defined through two sidewalls separated by the groove 14 and a limitation pin 50 extends through the two passages 13. The limitation pin 50 is engaged with the concavity 23 to limit the sliding jaw 20 from dropping from the groove 14.

Figure 3:
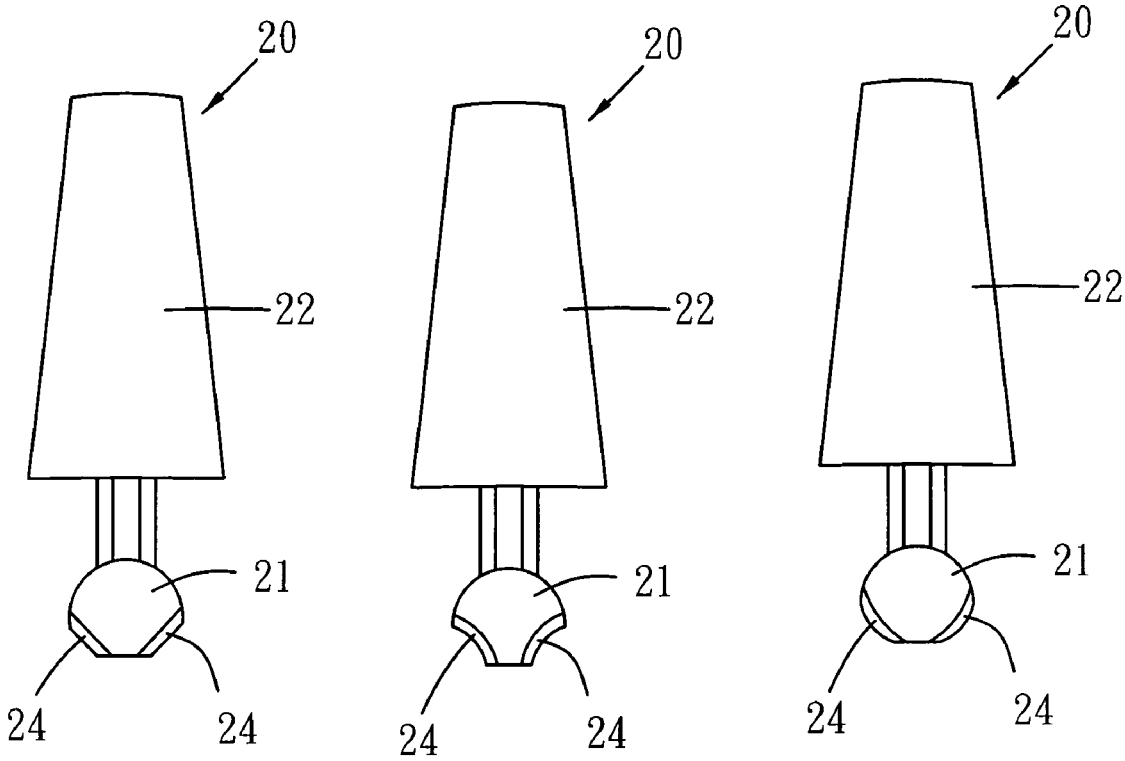
FIG. 3 shows different shapes of the toothed surfaces of the guide portion.
Figure 4:
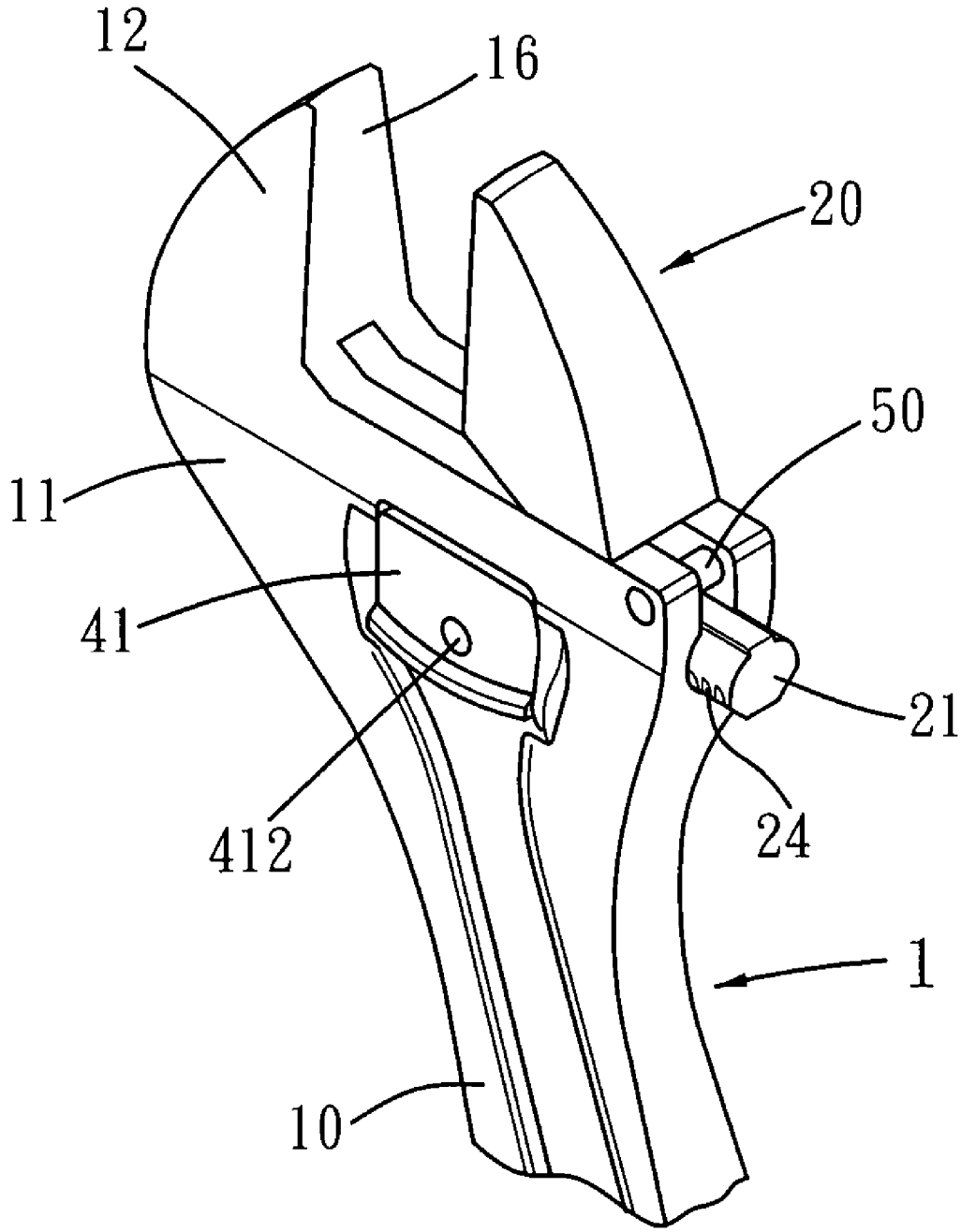
FIG. 4 is a perspective view to show the wrench of the present invention.

The two toothed surfaces 24 can be defined in two inclined surfaces, two recessed surfaces or two curved and convex surfaces of the guide portion 21 as shown in FIG. 3. The two toothed surfaces 24 are composed of teeth with different pitches, in other words, the teeth of the two toothed surfaces 24 are made by Metric system and English system respectively.

A control unit 30 includes two pawls 31 which are engaged with the through hole 15 and located on two sides of the head 11. Each pawl 31 includes an engaging surface 32 in a first end thereof and the engaging surface 31 is composed of teeth which are removably engaged with one of the two toothed surfaces 24. The teeth of the two toothed surfaces 24 are shaped to be corresponding to the teeth of the teeth of the two pawls 32. A second end of each pawl 31 includes two recesses 34 defined therein and two respective ends of two resilient members 35 are inserted into the two recesses 34 so as to push the pawl 31 toward the guide portion 21.

An operation unit 40 includes two operation members 41 and at least one pin 42. The two operation members 41 are located on the two sides of the head 11 and close the through hole 15 and the pin 42 extends through two holes 411 in the two operation members 41 and two oval holes 33 in the two pawls 31. Each of the operation members 41 includes a flange 412 extending from an outside thereof so that the user can conveniently pull the operation members 41 by the flanges 412.

Figure 5:
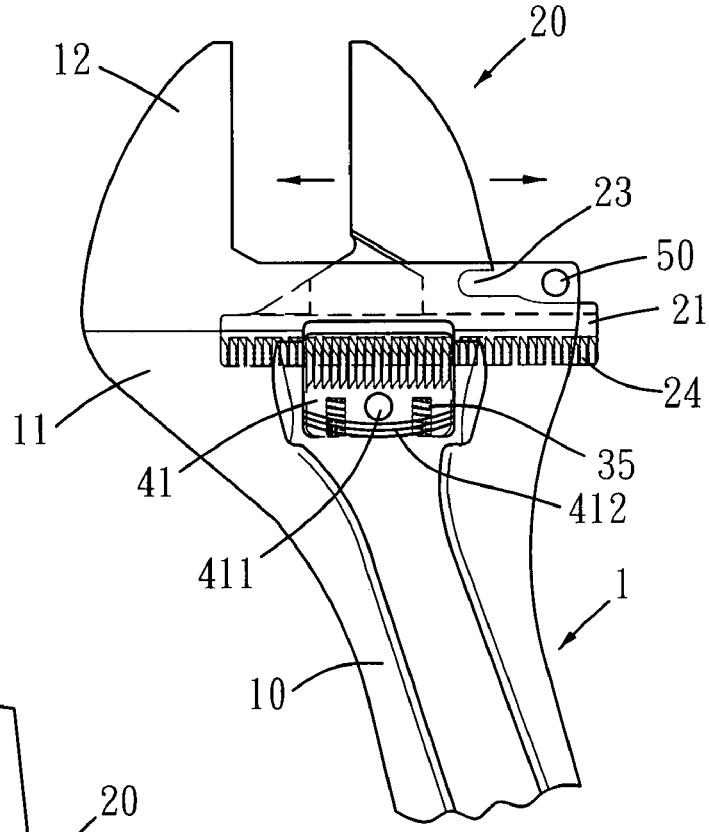
FIG. 5 shows the sliding jaw is moved when the pawls are pushed downward.
Figure 6:
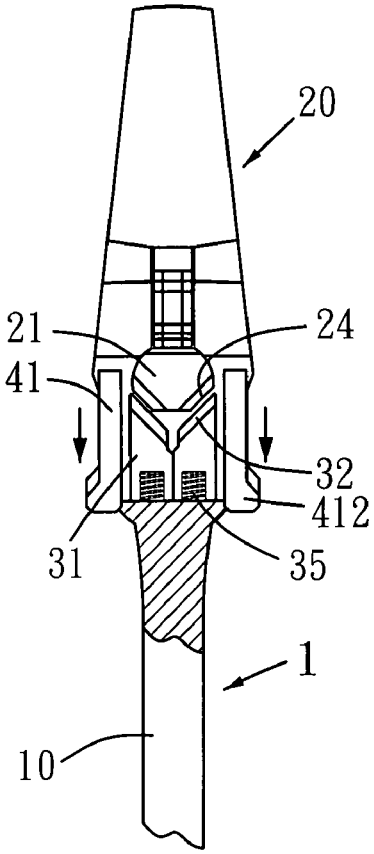
FIG. 6 shows a partial cross sectional view to show that the pawls are pushed downward.

As shown in FIGS. 5 and 6, when the user wants to move the sliding jaw 20, he or she simply pulls the two flanges 412 on the operation members 41, the two pawls 31 are then pulled away from the guide portion 21 so that the engaging surfaces 32 are disengaged from the toothed surfaces 24 of the guide portion 21. The sliding jaw 20 is then moved relative to the fixed jaw 12.

Figure 7:
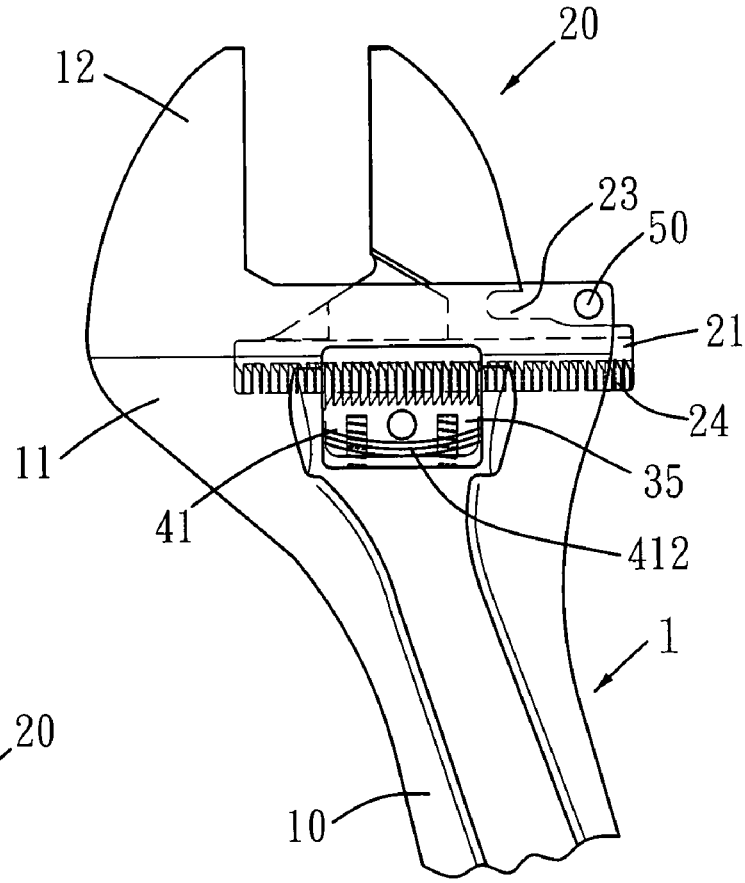
FIG. 7 shows the sliding jaw is positioned when the pawls are moved upward.
Figure 8:
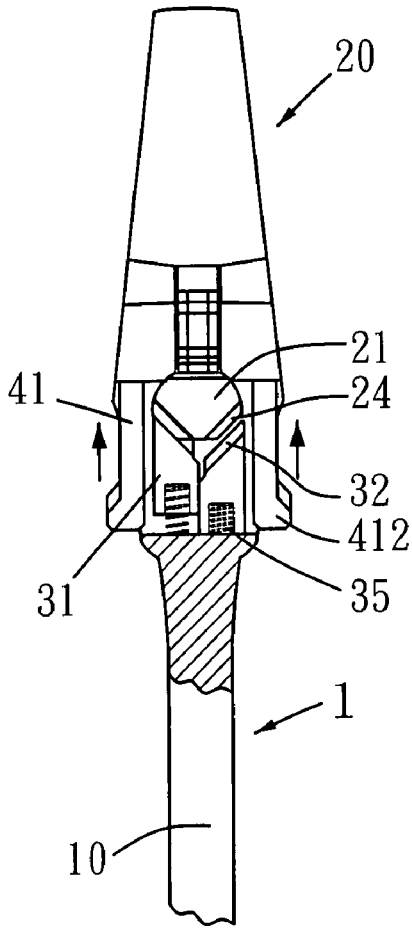
FIG. 8 shows a partial cross sectional view to show that the pawls are moved upward.

As shown in FIGS. 7 and 8, when releasing the operation members 41 and moving the sliding jaw 20 toward the fixed jaw 12, due to both of the teeth of the toothed surfaces 24 and the teeth of the two engaging surfaces 32 have inclined sides which allow the teeth of the toothed surfaces 24 to move over the teeth of the engaging surfaces 32. The sliding jaw 20 is stopped when the second clamp surface 22 contacts the object between the sliding jaw 20 and the fixed jaw 12. One of the engaging surfaces 32 is engaged with one of the two toothed surfaces 24 to position the sliding jaw 20. It is noted that the two toothed surfaces 24 and the two engaging surfaces 32 are made by Metric and English systems so that the wrench can clamp an object of either Metric or English system.

Figure 9:
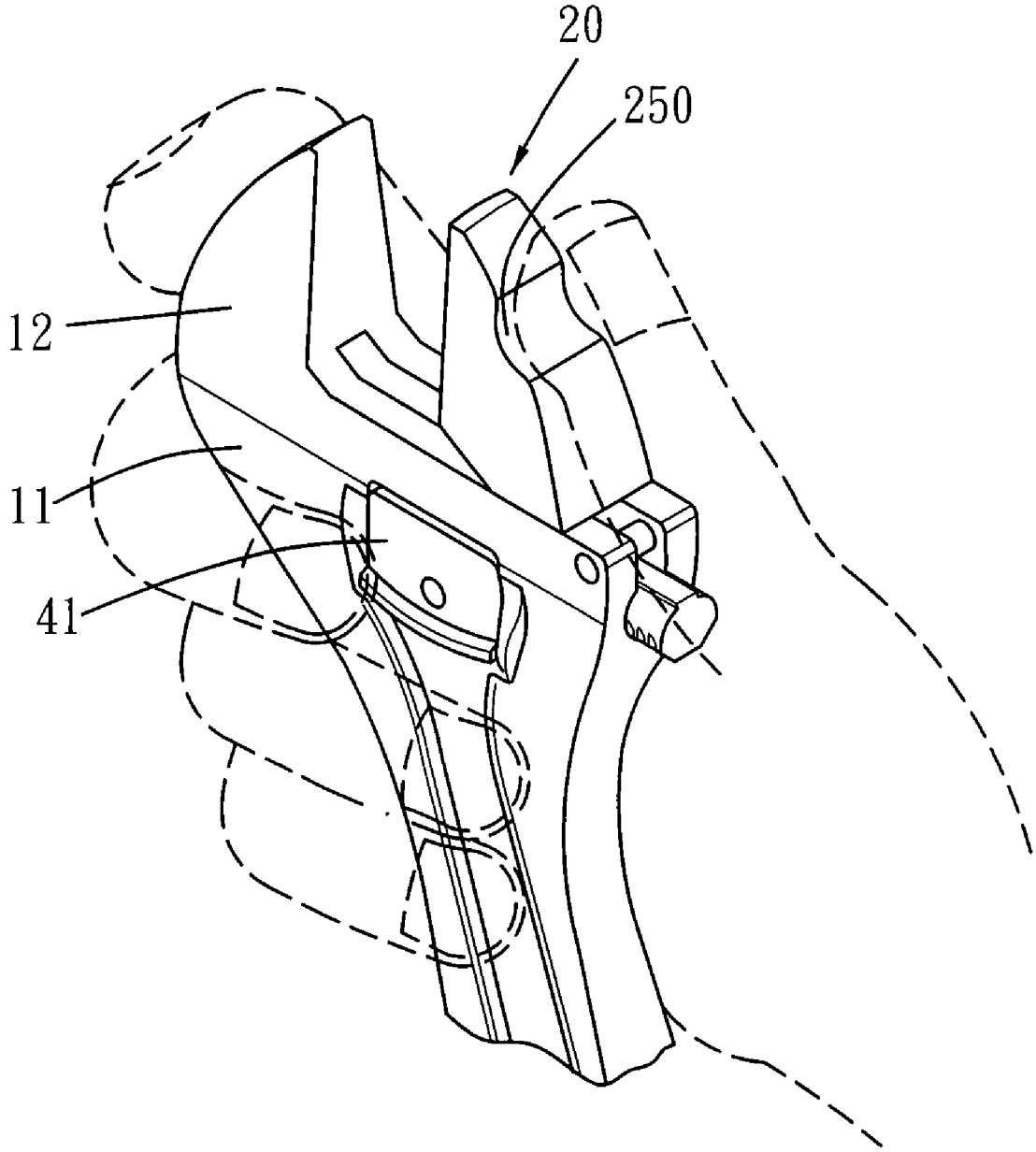
FIG. 9 shows that the jaw portion of the sliding jaw includes a thumb recess.

FIG. 9 shows that the jaw portion 25 of the sliding jaw 20 includes a thumb recess 250 defined in an outer surface thereof, so that the user can move the sliding jaw 20 by putting the thumb in the thumb recess 250 and push the sliding jaw 20.

Figure 10:
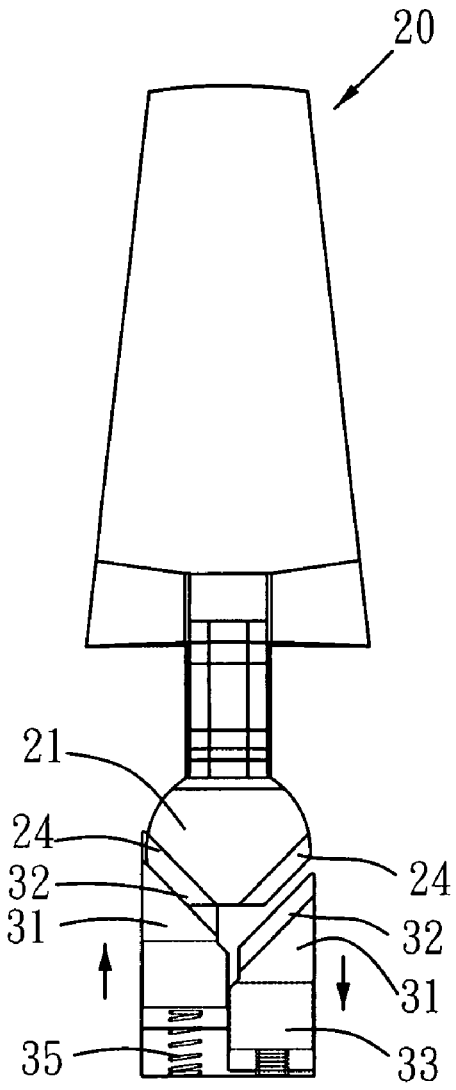
FIG. 10 shows that one of the two pawls is engaged with one of the toothed surfaces of the sliding jaw.
Figure 11:
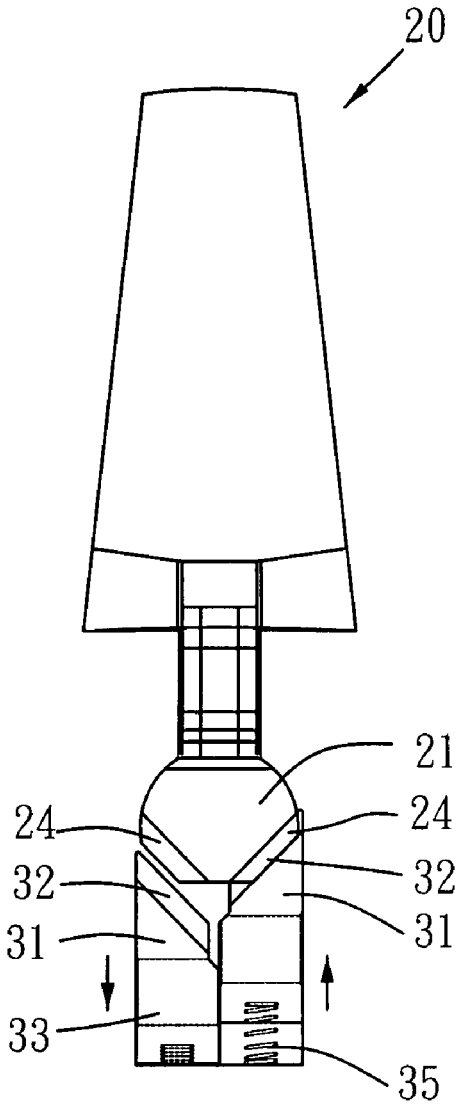
FIG. 11 shows that the other one of the two pawls is engaged with the other one of the toothed surfaces of the sliding jaw.

As shown in FIGS. 10 and 11, if the engaging surface 32 of the left pawl 31 and the left toothed surface 24 of the guide portion 21 are made by English system, and the engaging surface 32 of the right pawl 31 and the right toothed surface 24 of the guide portion 21 are made by Metric system, when moving the sliding jaw 20, the teeth of the toothed surfaces 24 will move over the two engaging surfaces 32 until the sliding jaw 20 contacts the object, and the left engaging surface 32 is engaged with the left toothed surface 24 if the object is made by English system, and when the right engaging surface 32 is engaged with the right toothed surface 24 if the object is made by Metric system. This ensures that the object can be precisely clamped and the user needs not to check the object is made by Metric or English system.

In addition, the teeth of the two toothed surfaces 24 are made to have same pitch and arranged alternately. If the pitch is 1 mm, the distance between the corresponding two teeth of the two toothed surfaces 24 along the guide portion 21 will be 0.5 mm. This makes the wrench to clamp an object to a precision of 0.5 mm.

While we have shown and described the embodiment in accordance with the present invention, it should be clear to those skilled in the art that further embodiments may be made without departing from the scope of the present invention.

What is claimed is:

1. A wrench comprising:

a handle and a head connected to an end of the handle, the head including a fixed jaw and a groove defined in an end of the head and opening through a top surface of the head, a through hole defined through the head and an axis of the through hole being perpendicular to an axis of the groove;

a sliding jaw having a cylindrical guide portion which includes two toothed surfaces defined in axial direction of the portion, the guide portion movably inserted into the groove;

a control unit including two pawls which are engaged with the through hole and located on two sides of the head, each pawl including an engaging surface in a first end thereof and the engaging surface composed of teeth which are removably engaged with one of the two toothed surfaces, a second end of each pawl being biased by a resilient member which pushes the pawl toward the guide portion, and an operation unit including two operation members and at least one pin, the two operation members located on the two sides of the head and the pin connecting the operation members and the pawls on the two sides of the head.

2. The wrench as claimed in claim 1, wherein the two toothed surfaces are located along two sides of an underside of the guide portion.

3. The wrench as claimed in claim 2, wherein the two toothed surfaces are defined in two inclined surfaces of the guide portion.

4. The wrench as claimed in claim 1, wherein the two toothed surfaces are composed of teeth with different pitches.

5. The wrench as claimed in claim 1, wherein the two toothed surfaces are composed of teeth with the same pitches and the teeth of the two toothed surfaces are located alternately.

6. The wrench as claimed in claim 4, wherein the teeth of the two toothed surfaces are made in Metric system and English system respectively.

7. The wrench as claimed in claim 1, wherein the teeth of the two toothed surfaces are shaped to be corresponding to the teeth of the teeth of the two pawls.

8. The wrench as claimed in claim 1, wherein each of the pawls includes an oval hole through which one of the at least one pins extends.

9. The wrench as claimed in claim 1, wherein each of the operation members includes a flange extending from an outside thereof.

* * * * *